United States Patent [19]

Ball

[11] Patent Number: 4,460,227

[45] Date of Patent: Jul. 17, 1984

[54] SEALING GROMMET MEANS

[75] Inventor: David J. Ball, Pacific Palisades, Calif.

[73] Assignee: Automation Industries, Inc., Greenwich, Conn.

[21] Appl. No.: 284,249

[22] Filed: Jul. 17, 1981 (Under 37 CFR 1.47)

[51] Int. Cl.[3] ..... H01R 13/56

[52] U.S. Cl. ..... 339/94 M; 174/152 G; 339/103 B

[58] Field of Search ..... 339/94, 89 M; 174/65 G, 174/152 G, 153 G, 177 R, 65 SS

[56] References Cited

U.S. PATENT DOCUMENTS

| | | | |
|---|---|---|---|
| Re. 24,438 | 2/1958 | Moorhead | 339/103 B |
| 1,800,578 | 4/1931 | Webb | 339/94 A |
| 1,809,864 | 6/1931 | Pearson | 174/152 G |
| 2,820,088 | 1/1958 | Sperry | 174/152 G X |
| 4,084,875 | 4/1978 | Yamamoto | 339/94 M |
| 4,154,496 | 5/1979 | Gallagher | 339/89 M X |
| 4,274,702 | 6/1981 | Buck et al. | 339/94 M X |
| 4,340,265 | 7/1982 | Ott et al. | 339/177 R X |
| 4,375,011 | 2/1983 | Grünau | 174/65 SS |

FOREIGN PATENT DOCUMENTS

| | | | |
|---|---|---|---|
| 587643 | 5/1947 | United Kingdom | 339/94 M |

OTHER PUBLICATIONS

"Cover Seal for Platen Shaft", Westphal, IBM Tech. Discl. Bull., vol. 18, No. 4, 9-1975, p. 1149.

*Primary Examiner*—Eugene F. Desmond
*Attorney, Agent, or Firm*—Francis N. Carten

[57] ABSTRACT

A multi-wire cable grommet constructed of a pliable material has a plurality of apertures extending therethrough and wire-sealing wall portions, one for each cable wire. Centrally located and extending angularly inwardly from the aperture wall is a generally cone-shaped wall portion which terminates in an opening smaller than the wire diameter. The opening in the cone-shaped portion lies on the aperture axis and is encompassed by a bead with wall thickness being relatively thin so that any wire movements transversely of the aperture axis will be taken up by bending of the conical wall rather than by any tendency of the conical member opening bead to be stretched away from sealing relationship with the wire.

12 Claims, 6 Drawing Figures

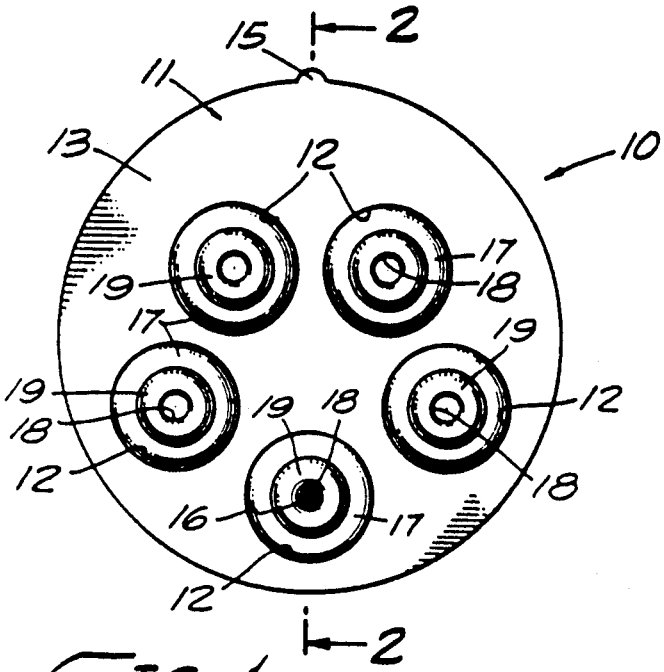
FIG. 1.
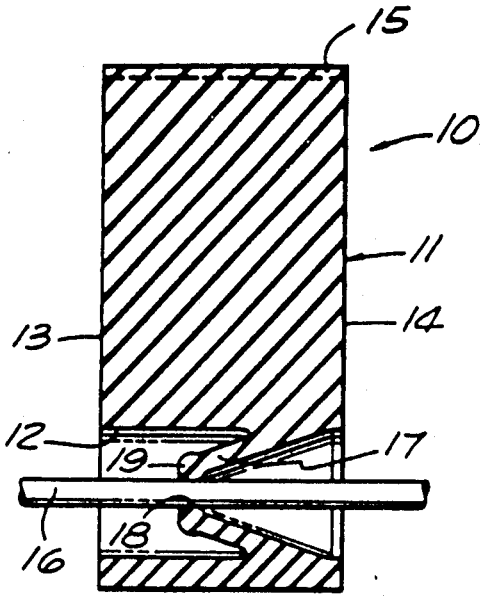
FIG. 2.
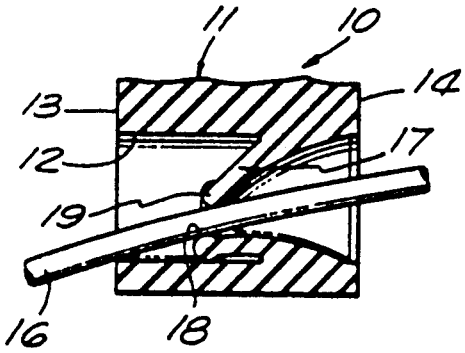
FIG. 3.
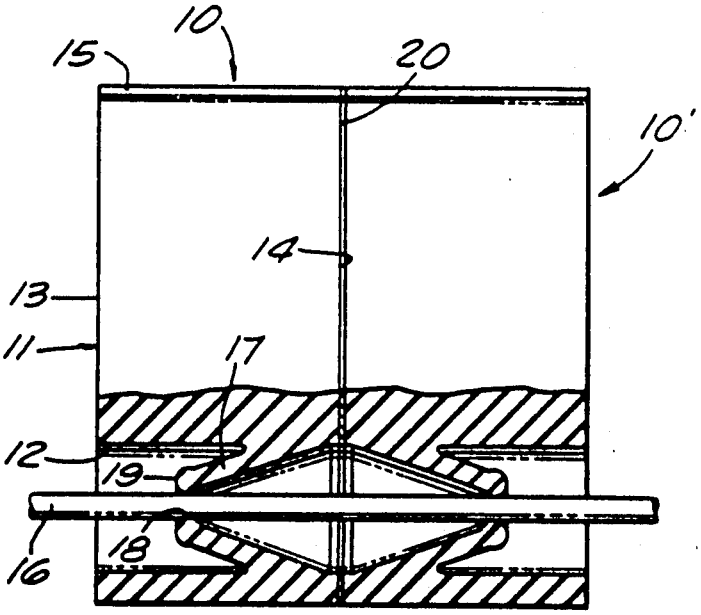
FIG. 4.
FIG. 5.
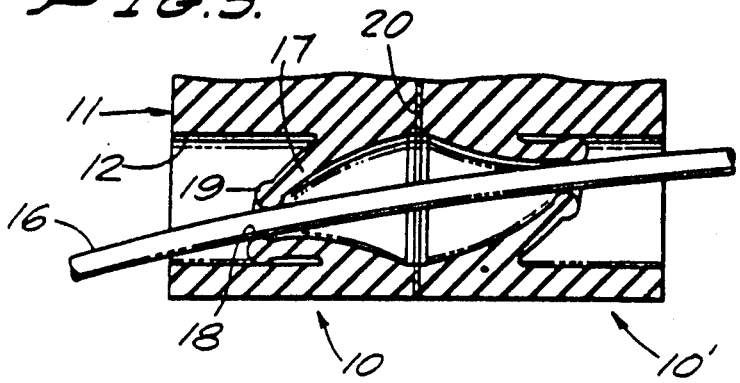

SEALING GROMMET MEANS

The present invention relates generally to a grommet means for being sealingly received onto an electrical wire, and, more particularly, to such a grommet means providing a sealing relation for a plurality of cable wires in an electrical connector.

BACKGROUND OF THE INVENTION

In a typical form of electrical connector, plug and receptacle parts are each interconnected to separate multiwire cables, the connector parts including pin and socket contacts which releasably mate together when the parts are assembled. It is conventional to pass the cable wires through rubber grommets or inserts in the connector subsequent to their being affixed to a pin or socket contacts, as the case may be. In the past, these grommets have only been effective for sealing the connector interior from the ingress of moisture, dust and dirt and the like when the wires passing through the grommet are substantially straight and well aligned with the grommet opening axis. It has been found with prior known grommets that even a relatively few degrees of axial displacement of the cable wires produces a deformation of the grommet apertures preventing a completely satisfactory sealing relationship.

SUMMARY OF THE INVENTION

In the practice of the present invention there is provided a one-piece grommet constructed of a pliable material including a plurality of apertures extenting therethrough and wire-sealing wall portions, one for each cable wire. Each aperture is substantially greater than the cable wire diameter. Centrally located within the grommet and extending angularly inwardly from the aperture wall is a generally cone-shaped portion of the wall which terminates in an opening smaller than the wire diameter. The opening in the cone-shaped portion lies on the aperture axis and is encompassed by a bead. The wall thickness of the cone is relatively thin so that any wire movements transversely of the aperture axis will be take up by bending of the conical wall rather than by any tendency of the conical member opening bead to be stretched away from the wire breaking the seal about the wire.

As an alternative, two such grommets are arranged in back-to-back relationship with the apertures respectively aligned so that in the normal unstressed condition the cone-shaped portions extend away from each other.

DESCRIPTION OF THE DRAWING

FIG. 1 is an end elevational view of a grommet constructed in accordance with this invention.

FIG. 2 is a side elevational, sectional view of the grommet taken along the line 2—2 of FIG. 1 showing a cable wire in place.

FIG. 3 is a side elevational, sectional, partially fragmentary view similar to FIG. 2 showing the wire experiencing side-pull.

FIG. 4 shows an alternate embodiment of the invention in which two grommets of FIG. 1 are arranged in back-to-back relation.

FIG. 5 shows a partially fragmentary view similar to FIG. 4 with the wire experiencing side-pull.

DESCRIPTION OF PREFERRED EMBODIMENTS

Figure 6:
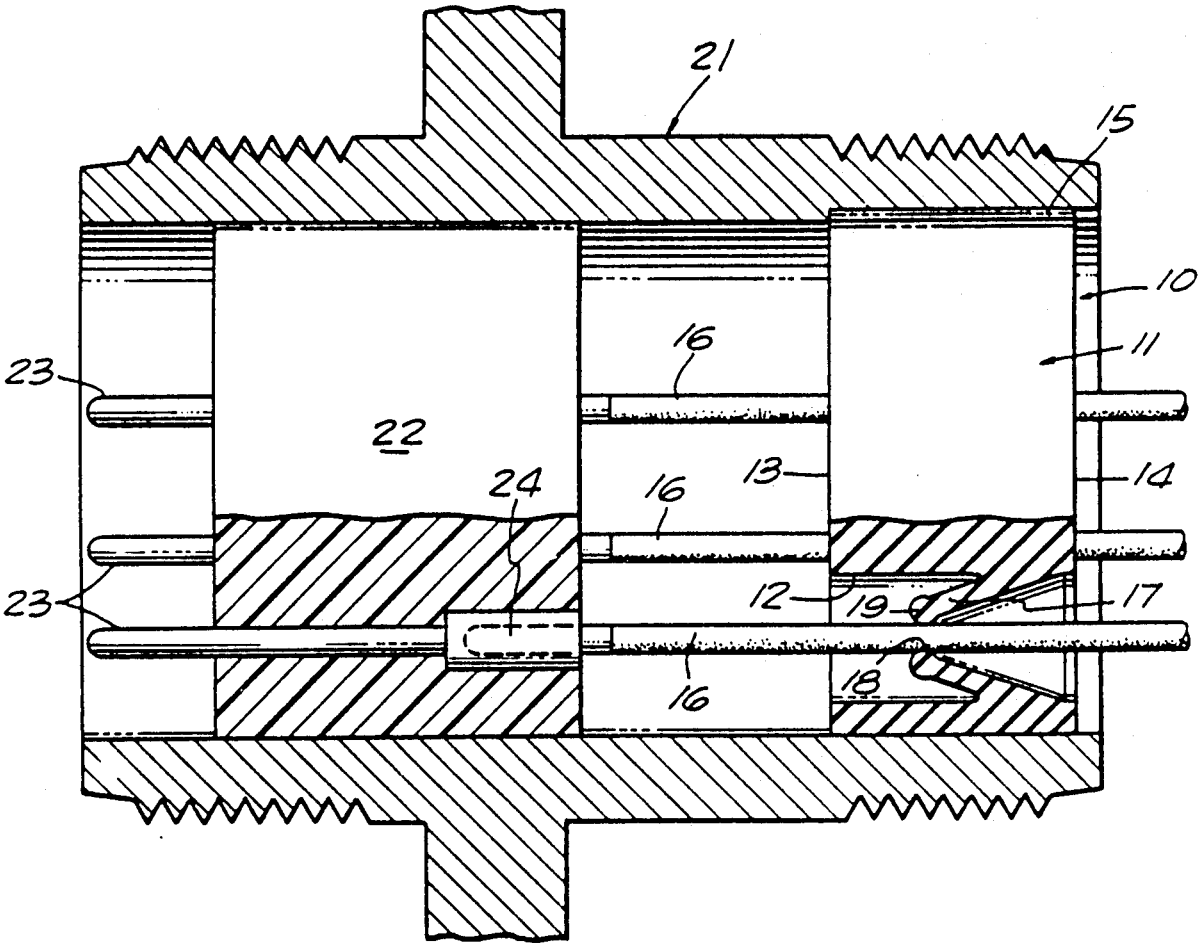
FIG. 6 depicts the grommet assembled into a connector part.

With reference now to the drawings and particularly FIGS. 1 and 2, the wire sealing grommet of the present invention is identified generally as at 10 and is seen to include a generally disklike body 11 having a plurality of mutually parallel cylindrical apertures 12 passing therethrough from an entrance face 13 to an exit face 14. A longitudinally extending key ridge 15 on the circumferential peripheral surface of the body 11 is a visual means for aligning and locating the grommet in a given orientation with respect to the connector parts. The outer diameter of the grommet body 11 is such as to permit fitting receipt within an accommodating opening of a connector part as shown in FIG. 6, for example, as will be described in detail later herein.

The circular entrance face 13 in assembly will be directed outwardly of the connector whereas the exit circular face 14 will face to the connector internal parts. That is, in assembly, wires 16 of the cable will be introduced into apertures 12 from the face 13 side of the grommet and exit at the face 14.

It is important that the material composing the body 11 not only exhibit good resistance to abrasion, moisture and the like, but also be highly compliant and flexible in order to provide optimum wire sealing properties. Although various rubbers and plastics may be found suitable for this purpose, to date best results have been obtained by molding the grommet body 11 from a silicone or fluorosilicone rubber having a Shore durometer of 30–40. This type of rubber maintains its flexibility over a wide temperature range and ages well.

The aperture 12 has a diameter at least several and preferably four to five times that of a cable wire 16 to accommodate the sealing structure to be described at this time.

Each opening 12 has the walls thereof closely adjacent the exit or inner face 14 formed into a tube 17, the sides of which taper inwardly toward the entrance face 13 forming cone terminating in an opening 18 lying on the axis of aperture 12. The cone opening 18 is defined and reinforced by a circular bead 19. More particularly, the conical tubes 17 are integral with the main grommet body 11 beginning just inwardly of the exit face 14 where the tube bore diameter is substantially equal to the diameter of the aperture 12. The side walls of the tube 17 as they move away from the exit face 14 taper inwardly in a uniform manner terminating at a point beyond the center of the body 11 as measured along the aperture axis but substantially short of the entrance face 13. The diameter of the opening 18 as defined by the bead 19 is significantly less than the wire diameter so that when a wire is pressed through the opening the bead will be stretched and thereby be tightly and sealingly secured about the wire. With this construction, even when a wire 16 is subjected to a considerable side-pull as shown in FIG. 3 and the conical side wall deform to the point where the bead 19 contacts the aperture side wall, the bead still remains tightly and sealingly retained about the wire.

Although some variation in relative dimensions of the grommet parts may be found not to be detrimental to efficient operation of the invention, best results have been obtained in a practical construction where the body spacing between faces 13 and 14 was 0.200 inches (0.508 cm.), aperture diameter was 0.105 inches (0.267 cm.), the conical tube wall thickness was 0.018 inches (0.046 cm.) and the conical tube angle was 40 degrees. The opening formed by the bead 19 was 0.020 inches (0.051 cm.) which was specifically designed to accommodate an insulated wire having an outer diameter of approximately 0.040 inches (0.102 cm.).

In situations where a considerable amount of repetitive wire side-pull is to be encountered or the wire diameter is substantial (e.g., above about 0.079 inches in diameter) it may be advisable for insured reliability of sealing to employ the alternative embodiment shown in FIGS. 4 and 5. In essence, this version includes two of the grommets 10 and 10' with their respective exit faces 14 secured together by a suitable cementitious material 20. Accordingly, the corresponding apertures 12 of the two back-to-back grommets 10 are axially aligned with the conical tubes 17 in each common aperture being directed oppositely. Side-pull can produce deformation of both sealing tubes 17 as shown in FIG. 5, or if one end of the wire 16 is held centrally aligned and the other wire end subjected to side-pull only the one sealing tube will be deformed.

With reference now to FIG. 6, a typical connector part 21 is depicted with which the described wire sealing grommet 10 may be advantageously employed. Specifically, the connector part 21 is a hollow cylindrical body including an insert 22 within which a plurality of pin contacts 23 (or socket contacts) are secured. Cable wires 16 to be connected to the pin contacts as at 24 extend through individual apertures 12 of a grommet 10 and are thereby sealed in the manner described. The grommet is positioned within the connector part bore by using the ridge 15 to effect visual alignment.

I claim:

1. Grommet means for being slidably and sealingly received onto an elongated member subject to transverse movement, comprising:

a body of flexible, elastic material having an aperture passing therethrough of cross-sectional dimensions greater than those of the member, walls defining said aperture forming a hollow tube extending along said aperture with a terminal opening of dimensions less than those of the member, said hollow tube being located within the aperture with no tube parts extending outwardly of said aperture, the tube wall defining the tube opening being flexedly movable transversely of the aperture into contact with the body defining the aperture without changing the tube opening dimensions.

2. Grommet means as in claim 1, in which the body and tube are constructed of fluorosilicone rubber.

3. Grommet means as in claim 1, in which the tube sides defining the terminal opening are formed into a continuous thickened bead.

4. Grommet means as in claim 1, in which the body aperture is circular in cross-section and of a diameter at least twice the maximum cross-sectional dimension of the member.

5. Grommet means as in claim 1, in which the body is cylindrical with first and second parallel circular faces, said aperture extending in a straight line through the body intercepting said first and second circular faces at substantially ninety degrees and said tube being spaced inwardly from said first and second faces within the aperture.

6. Grommet means as in claim 1, in which said body includes a plurality of said apertures and respective tubes formed therein.

7. In a wire-sealing grommet for receipt within a cavity of a plug and receptacle connector part including a body constructed of an elastically distendible and compressible material with its periphery formed for fitting receipt, a plurality of spaced substantially parallel apertures formed in the body of cross-sectional dimensions exceeding those of the wire, the improvement comprising:

hollow tubular means integral with the body walls defining each aperture extending along the aperture in spaced relation from the aperture walls and lying wholly within said aperture, each said tubular means having a terminal opening of cross-sectional dimensions less than those of the wire forming a continuous seal about the wire and having walls spaced inwardly from the walls defining the aperture within which the said tubular means is received, the tubular means wall defining the tube opening being flexedly movable transversely of the aperture into contact with the body defining the aperture without changing the tube opening dimensions.

8. A wire-sealing grommet as in claim 7, in which the walls of the tubular means are tapered from an initial opening approximately equal to the aperture cross-sectional to the terminal opening.

9. A wire-sealing grommet as in claim 7, in which the tublar means walls defining the terminal opening are thickened whereby the remainder of the tubular means requires less force to produce flexing than at the thickened part.

10. A wire-sealing grommet as in claim 7, in which the tubular means all extend in the same direction.

11. A wire-sealing grommet as in claim 7, including a ridge on the body periphery for aligning the grommet in said connector part to achieve a predetermined orientation therebetween.

12. A wire-sealing grommet, comprising:

first and second bodies constructed of an elastic material, each having first and second flat parallel faces;

said first and second bodies each including an aperture extending through the said body normally to the first and second faces and having a tubular means of lesser cross-sectional dimensions than said aperture affixed to the walls defining the aperture and extending toward the body first face along the aperture with walls of the tubular means being spaced from the walls defining the aperture;

said bodies being arranged with their respective second faces in contact and the apertures aligned; and means for unitarily securing said bodies together.

* * * * *